US007495176B2

(12) United States Patent
Winkelbauer et al.

(10) Patent No.: US 7,495,176 B2
(45) Date of Patent: Feb. 24, 2009

(54) FLEXIBLE ELECTRIC CONTROL CABLE

(75) Inventors: Walter Winkelbauer, Duisburg (DE); Frank Müller, Frechen (DE); Heinz Willi Hamacher, Mönchengladbach (DE)

(73) Assignee: Nexans (FR)

( * ) Notice: Subject to any disclaimer, the term of this patent is extended or adjusted under 35 U.S.C. 154(b) by 0 days.

(21) Appl. No.: 11/786,048

(22) Filed: Apr. 10, 2007

(65) Prior Publication Data

US 2008/0251272 A1 Oct. 16, 2008

(51) Int. Cl.
*H01B 11/02* (2006.01)

(52) U.S. Cl. ..... 174/113 C; 174/116

(58) Field of Classification Search ..... 174/113 R, 174/116, 113 C, 105 R
See application file for complete search history.

(56) References Cited

U.S. PATENT DOCUMENTS

| | | | | |
|---|---|---|---|---|
| 2,235,523 | A | 3/1941 | Hull | |
| 2,900,437 | A | 8/1959 | Thompson | |
| 4,677,256 | A | 6/1987 | Bauer | 174/116 |
| 4,861,947 | A | 8/1989 | Altermatt et al. | 174/113 |
| 5,092,381 | A | 3/1992 | Feijen et al. | |
| 5,216,205 | A | 6/1993 | Fujii et al. | 174/128.1 |
| 5,821,466 | A * | 10/1998 | Clark et al. | 174/113 R |

FOREIGN PATENT DOCUMENTS

| | | |
|---|---|---|
| DE | 3336616 | 4/1985 |
| DE | 10315609 | 10/2004 |
| DE | 102004044452 | 4/2006 |
| GB | 838494 | 6/1960 |
| GB | 1479209 | 7/1977 |
| GB | 2023328 | 12/1979 |

OTHER PUBLICATIONS

German Search Report dated Apr. 19, 2006.

* cited by examiner

*Primary Examiner*—Chau N Nguyen
(74) *Attorney, Agent, or Firm*—Sofer & Haroun, LLP

(57) ABSTRACT

A description is given of a flexible electric control cable in which one or more layers of control wires are stranded on a central element and the at least one layer of control wires is surrounded by an outer jacket, the central element (1) comprising at least one pair of wires (1*a*, 1*b*) and each wire (1*a*, 1*b*) of the pair of wires comprising a core element (10) of a tension-resistant plastic, a layer of metal wires (11) stranded on the core element (10) and a layer (12) of a compressible insulating material sheathing the stranded layer, and the wires (1*a*, 1*b*) of the pair of wires being stranded with one another with a length of lay of 20 to 40 D, where D is the diameter of the pair of wires.

9 Claims, 1 Drawing Sheet

FLEXIBLE ELECTRIC CONTROL CABLE

FIELD OF THE INVENTION

The invention relates to a flexible electric control cable according to the precharacterizing clause of claim 1.

BACKGROUND

EP 0 178 249 B1 discloses a flexible electric control cable in which a number of bundles of wires are stranded on a core element formed as a supporting element, in which each bundle of wires comprises a core element with wires stranded on it and in which the core formed by the supporting element and the wires is surrounded with a braiding and a plastic jacket. Application areas for such cables are container loading devices (spreader cables). To improve the running of the cable under the effect of wind forces, and consequently make it possible for such a cable to be used as a spreader cable, the core element formed as a supporting element comprises an assembly of braided lead cords on which a braid of tension-resistant plastic filaments is applied. The core element of each bundle of wires comprises a braided lead cord, and braided lead cords are likewise arranged in the outer interstices of the core. The braided lead cords bring about an increase in the dead weight without noticeably increasing its flow resistance in the transverse direction or reducing its flexibility.

DE 33 36 616 discloses a drum-windable control cable, such as are used in container loading devices. During the moving up and down of the hoist, the cable is constantly wound up onto and unwound from the drum or placed over a hopper and taken up again. The cable is in this case allowed to run freely through the air vertically over a considerable height. In strong winds, this can lead to severe buckling of the cable, which can hinder the sequence of movements of the cable. To solve the problems described, it is proposed in the case of a drum-windable cable with stranding elements stranded in at least two stranding layers, in which the first stranding layer is arranged around a supporting element with a steel cable, that at least one stranding layer is provided with stranding elements that comprise a braided lead cord, an extruded polyamide- or polyester-based sheathing surrounding the lead cord and aramid-based rovings arranged between the lead cord and the sheathing in such a way that they run in longitudinally. The aramid-based rovings contribute both to maintaining the flexibility of the cable and maintaining the required tensile strength.

OBJECTS AND SUMMARY

The present invention is based on the object of providing a cable of the type mentioned at the beginning with which it is possible to permit an in-situ measurement of the tensile forces acting on the cable and, on the basis of the measured values, control the winding speed with which the cable is wound up onto and unwound from a drum during operation.

Apart from the advantages arising directly from the object, there is also the advantage that higher winding speeds are achieved. In addition, an increase in the service lives of the cable and of the overall system is also achieved.

BRIEF DESCRIPTION OF DRAWINGS

The invention is to be described in more detail on the basis of the exemplary embodiments that are schematically represented in FIGS. 1 and 2.

DETAILED DESCRIPTION

Figure 1:
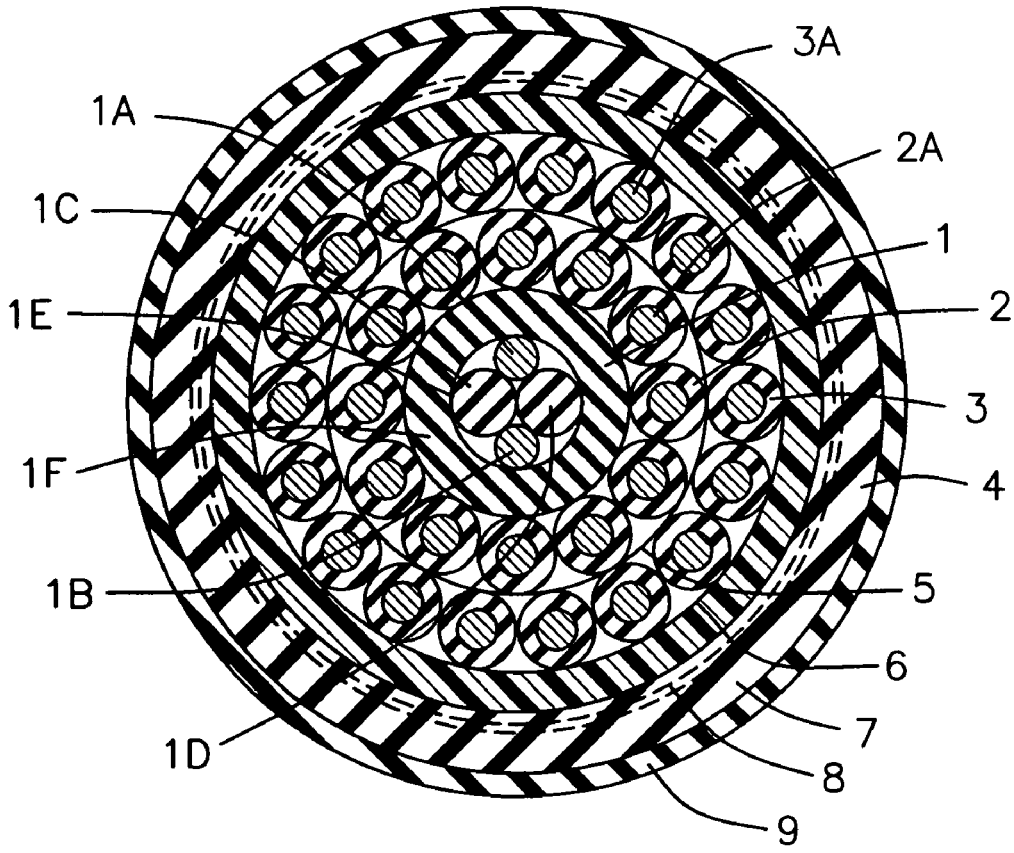
FIG. 1 shows a drum-windable cable in accordance with one embodiment.

FIG. 1 shows a drum-windable cable which has a central element 1, around which a first layer 2 of stranding elements 2*a* is stranded. Wound around the first layer 2 is a further layer 3 of stranding elements 3*a*. The cable core comprising the central element 1 and the layers 2 and 3 is surrounded by a jacket 4.

Each stranding element 2*a* and 3*a* has—as known per se—a not specifically designated, centrally arranged electrical conductor, for example a fine-wired copper conductor, and a not specifically designated insulation, for example based on ethylene-propylene rubber. Between the layer 2 and the layer 3 there is a separating layer 5 of a spunbonded fabric made of polyethylene terephthalate. The length of lay of the individual stranding elements is approximately 8 times the stranding diameter.

Arranged over the layer 3 there is a least one taping 6, likewise made of polyethylene terephthalate. It is preferred, however, for two tapings made of polyethylene terephthalate to be applied, with opposite directions of lay.

The taping 6 is sheathed by an inner jacket 7 made of an extruded rubber mixture, within the wall of which a braid 8 of polyester filaments is provided as a protection against torsion.

An extruded layer, which likewise consists of a material based on vulcanized or unvulcanized rubber, serves as the outer jacket 9.

The central element 1 comprises a pair of wires 1*a*, 1*b*, which is stranded together with two interstitial fillings 1*c*, 1*d*. The stranding element formed in this way is surrounded by a layer 1*e* of spunbonded polyethylene-terephthalate fabric. An extruded layer 1*f* of plastics material serves as the outer sheathing.

The spunbonded fabrics serve the purpose of making it possible for the respectively adjacent layers to slide with respect to one another.

Figure 2:
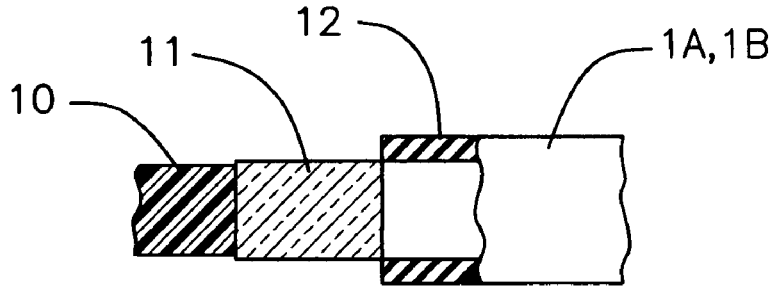
FIG. 2 shows a side cut-away view of elements 1*a* and 1*b* from FIG. 1, in accordance with one embodiment.

The wire 1*a* or 1*b* that is represented in FIG. 2 comprises a core 10 made of a tension-resistant plastic. Aramid, which is available on the market under the trade name Kevlar, is preferred for this. A multiplicity of copper wires 11 are stranded onto this core 10. The copper wires have with preference a diameter of 0.2 to 0.3 mm. There are between 20 and 60 of them. Over the layer of wires 11 there is a buffer tube 12, which consists of a compressible, elastically deformable material. With preference, the buffer tube 12 consists of an ethylene-propylene rubber.

The length of lay of the wires 1*a*, 1*b* and of the interstitial fillings 1*c*, 1*d* is between 20 and 40 D, where D is the outside diameter of the stranding element comprising the wires 1*a*, 1*b* and the interstitial fillings 1*c*, 1*d*. It is also important that the layer if is compressible.

In the case of the cable described, the stranding elements 2*a* and 3*a* serve for controlling the arms of the spreader.

When the spreader is moved up and down, the cable is exposed to tensile forces of different magnitudes.

One of the causes of these tensile forces is the dead weight of the cable that is wound up onto and unwound from a drum located above the spreader.

The constantly changing tensile forces acting on the cable have the effect of changing the distance between the conductors of the wires 1*a* and 1*b*. If current is flowing through the conductors, i.e. they are connected to a voltage source, the capacitance of the pair of wires 1*a*, 1*b* also changes. The changing of the capacitance is measured and is used as a controlled variable for controlling the winding speed of the winding drum.

The invention claimed is:

1. Flexible electric control cable comprising:

one or more layers of control wires stranded on a central element surrounded by an outer jacket, wherein said central element includes at least one pair of wires each wire of the pair of wires having a core element of a tension-resistant plastic, a layer of metal wires stranded on the core element, a layer of a compressible insulating material sheathing the stranded metal wires layer, where the wires of the pair of wires are stranded with one another with a length of lay of 20 to 40 D, where D is the outside diameter of the pair of wires, and where said central element is sheathed by a jacket of plastic.

2. Flexible electric control cable according to claim 1, wherein the core element is aramid.

3. Flexible electric control cable according to claim 1, wherein the metal wires are copper wires with a diameter of 0.2 to 0.3 mm and there are 30 to 50 of them.

4. Flexible electric control cable according claim 1, wherein the pair of wires is stranded together with two interstitial fillings.

5. Flexible electric control cable according to claim 4, wherein the interstitial fillings are twisted polyethylene terephthalate yarns.

6. Flexible electric control cable according to claim 1, wherein a taping of spunbonded polyethylene terephthalate fabric is arranged between the pair of wires and the jacket of plastic.

7. Flexible electric control cable according to claim 1, wherein the control wires are stranded around the central element in two layers and a layer of spunbonded polyethylene terephthalate fabric is arranged between the two layers.

8. Flexible electric control cable according to claim 7, wherein a taping of spunbonded PETP fabric is arranged over the outer layer of the control wires.

9. Flexible electric control cable according to claim 1, wherein a torsion protection in the form of polyester filaments is arranged within the wall thickness of an inner jacket.

* * * * *